US011583458B2

(12) United States Patent
Gonser et al.

(10) Patent No.: US 11,583,458 B2
(45) Date of Patent: Feb. 21, 2023

(54) SURGICAL TABLE

(71) Applicant: TRUMPF MEDIZIN SYSTEME GMBH + CO. KG, Saalfeld (DE)

(72) Inventors: Martin Gonser, Saalfeld (DE); Heinz-Hermann Dalbert, Bruckmuehl (DE); Frank Oelgarth, Saalfeld (DE); Ivo Mueller, Saalfeld (DE); Martin Schulze, Saalfeld (DE)

(73) Assignee: TRUMPF MEDIZIN SYSTEME GMBH + CO. KG, Saalfeld (DE)

( * ) Notice: Subject to any disclaimer, the term of this patent is extended or adjusted under 35 U.S.C. 154(b) by 96 days.

(21) Appl. No.: 16/555,325

(22) Filed: Aug. 29, 2019

(65) Prior Publication Data

US 2020/0069499 A1 Mar. 5, 2020

(30) Foreign Application Priority Data

Sep. 3, 2018 (EP) ..... 18192262

(51) Int. Cl.
*A61G 13/08* (2006.01)
*A61G 13/06* (2006.01)

(52) U.S. Cl.
CPC ..... *A61G 13/08* (2013.01); *A61G 13/06* (2013.01); *A61G 2203/16* (2013.01); *A61G 2203/32* (2013.01); *A61G 2205/20* (2013.01)

(58) Field of Classification Search
CPC .... A61G 13/08; A61G 13/06; A61G 2203/16; A61G 2203/32; A61G 2205/20; A61G 13/00; A61G 13/04; A61G 13/02; A61G 13/10; A61G 7/015; A61G 7/005; A61G 7/002; A61G 7/00; A61G 2203/44; A61G 2203/36; A61G 2203/14; Y10S 177/09; A47C 31/008
See application file for complete search history.

(56) References Cited

U.S. PATENT DOCUMENTS 4,865,303 A * 9/1989 Hall ..... A61G 13/04 5/614
6,754,923 B2 * 6/2004 Borders ..... A61G 12/00 5/618
2002/0170115 A1 * 11/2002 Borders ..... A61G 13/101 5/624
2009/0031497 A1 2/2009 Meissner et al.
2015/0245965 A1 * 9/2015 Griesel ..... A61B 17/2255 5/607

(Continued)

FOREIGN PATENT DOCUMENTS

CN 201642095 U 11/2010
CN 204121355 U 1/2015

(Continued)

*Primary Examiner* — David R Hare
*Assistant Examiner* — Madison Emanski
(74) *Attorney, Agent, or Firm* — Barnes & Thornburg LLP

(57) ABSTRACT

A surgical table comprises a tabletop having several tabletop sections, a column for supporting the tabletop by supporting one of the tabletop sections, and at least one operating unit, wherein one of the tabletop sections is a movable tabletop section configured to perform a motion with respect to at least one of an adjacent tabletop section and the column in a power-driven manner, and the operating unit is fixed to the movable tabletop section for actuating the motion.

11 Claims, 1 Drawing Sheet

(56) References Cited

U.S. PATENT DOCUMENTS

| | | | | |
|---|---|---|---|---|
| 2015/0297433 | A1* | 10/2015 | Owens | A61G 13/08 600/324 |
| 2016/0095773 | A1 | 4/2016 | Ruch et al. | |
| 2016/0374874 | A1* | 12/2016 | Trepanier | A61G 1/04 5/611 |
| 2017/0196748 | A1 | 7/2017 | Gaiser | |

FOREIGN PATENT DOCUMENTS

| | | | | |
|---|---|---|---|---|
| CN | 204890476 | U | 12/2015 | |
| CN | 207506738 | U | 6/2018 | |
| DE | 102013105869 | | 12/2014 | |
| EP | 1032350 | | 2/2002 | |
| EP | 2020217 | | 2/2009 | |
| EP | 3019133 | | 10/2017 | |
| WO | WO-9626615 | A1 * | 8/1996 | H01H 9/0214 |
| WO | WO2003/030802 | | 4/2003 | |
| WO | WO2010/068977 | | 6/2010 | |
| WO | WO2014/076095 | | 5/2014 | |

* cited by examiner

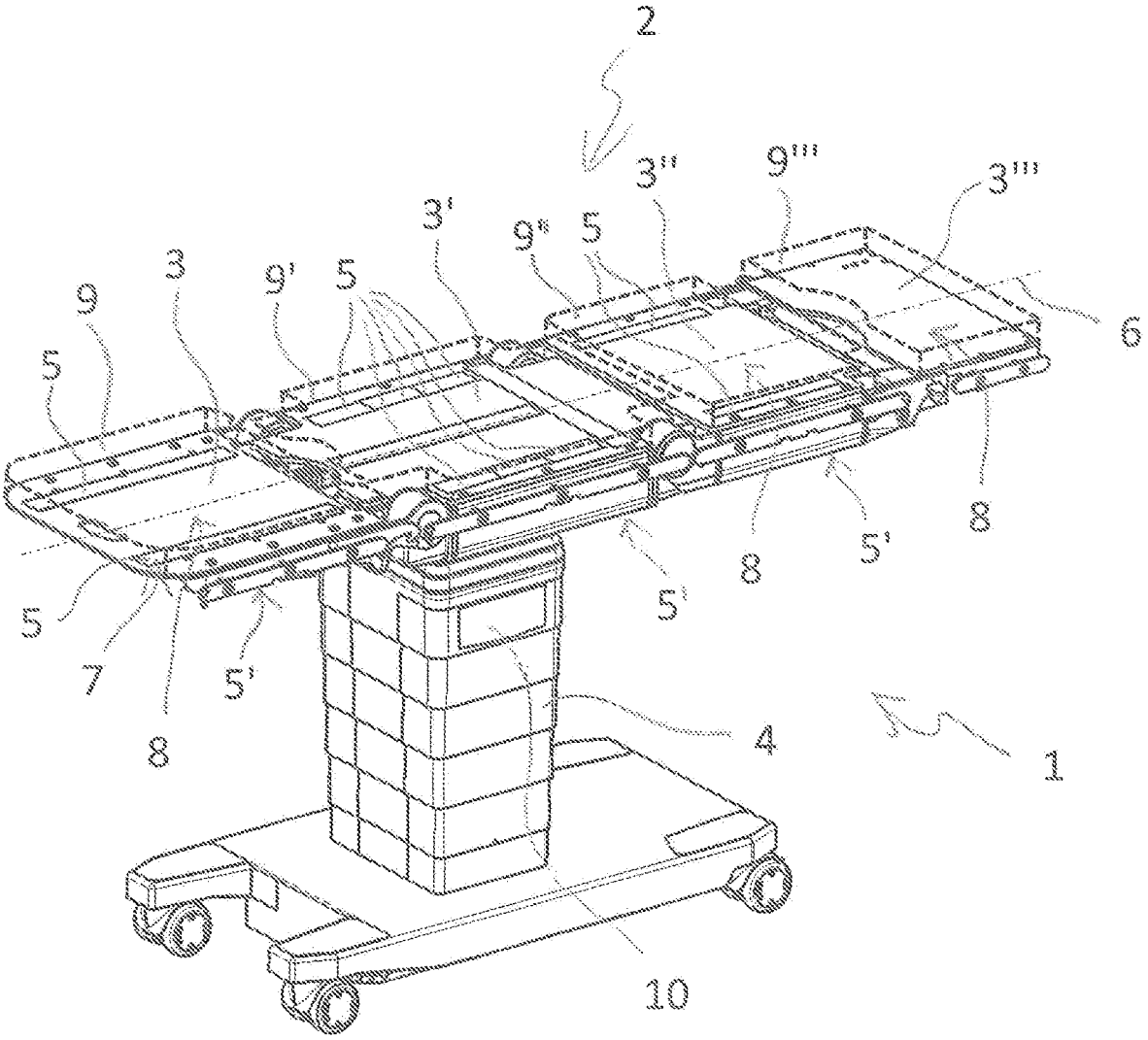
2
3''
9'''
3'''
3'
9''
5
3
9'
5
9
6
5
8
5'
8
5'
5
7
5'
8
4
1
10

SURGICAL TABLE

CROSS-REFERENCE TO RELATED APPLICATIONS

This application claims the benefit of European Patent Application Serial No. 18192262.6, filed on Sep. 3, 2018, the entire disclosure of which is incorporated herein by reference in its entirety.

BACKGROUND

The invention relates to a surgical table, in particular, to a surgical table having a power-driven tabletop.

SUMMARY

Caregivers, e.g. circulating nurses, anesthesiologists and surgeons, have to work with different medical apparatuses when working in an operating theater. Therefore, they have to be familiar with the operation of various apparatuses which, due to their functionality, are provided with complicated user interfaces which are lavishly to operate. Furthermore, the user interfaces must always be at caregiver's disposal.

Moreover, there are surgical interventions requiring an exact positioning of a patient. At the moment, this position is approached, for example, by pressing buttons on a remote control. However, an exact position of table top sections of the surgical table is hard to achieve.

Therefore, the object underlying the invention is to provide a surgical table which can be intuitively operated at the surgical table.

The object is achieved by surgical table according to the independent claims. Advantages further developments of the invention are included in the dependent claims.

According to an aspect of the invention, a surgical table comprises a tabletop having several tabletop sections and a column for supporting the tabletop by supporting one of the tabletop sections. Furthermore, the surgical table comprises at least one operating unit. One of the tabletop sections is a movable tabletop section configured to perform a motion with respect to at least one of an adjacent tabletop section and the column in a power-driven manner, and the operating unit is fixed to the movable tabletop section for actuating the motion.

By providing such a surgical table, the individual tabletop sections can be operated intuitively since the at least one operating unit is fixed to an assigned movable tabletop section and there is no need to search and hold a remote control in the hand. Therefore, patient positioning will be transferred into an effortless process, even for small adjustments. Thus, for caregivers, it will be much more convenient to position the patient to the correct desired position without the need to hold a pendant. Furthermore, fine tuning of positioning can be done more intuitively since a motion of a hand actuating the operating unit can be assisted by a drive of the tabletop section.

In an advantages implementation, the operating unit has a direction of actuation, and the direction of actuation corresponds to a direction of motion of the movable first tabletop section.

When the direction of actuation corresponds to the direction of motion of the movable tabletop section, there is no need to think about the use of the operating element and the surgical table can be operated more intuitively.

In a further advantages implementation, the movable tabletop section has a lying surface and the operating unit is configured to be actuated from a lying surface side and a further operating unit is configured to be actuated from a side opposite to the lying surface side.

By actuating the operating units from the lying surface side and, also, the side opposite to the lying surface side, an appropriate assignment of the actuation and the motion of the tabletop section for approaching specific positions of the patient is enabled.

In a further advantages implementation, the movable tabletop section is provided with a compressible upholstery on the lying surface side, and the operating unit is arranged below the lying surface provided by the upholstery.

Due to the location of the operating unit below the lying surface provided by the upholstery, by compressing the upholstery from an upholstery side, there is no need to look for the operating unit such that is very easy to intuitively operate a downward motion of the tabletop section by pressing onto the upholstery.

In a further advantageous implementation, the motion of the movable tabletop section comprises tilting with respect to the adjacent table top section.

By tilting the tabletop sections with respect to the adjacent table top section, an appropriate patient positioning for specific surgeries is intuitively possible.

In a further advantages implementation, the tabletop has a longitudinal axis and the motion of the tabletop section supported by the column comprises tilting around an axis parallel to the longitudinal axis.

By tilting the tabletop section around the axis parallel to the longitudinal axis, an appropriate patient positioning for specific surgeries is intuitively possible.

In a further advantages implementation, the tabletop has the longitudinal axis and the motion of the tabletop section supported by the column comprises tilting around an axis parallel to an axis perpendicular to the longitudinal axis.

By tilting the tabletop section around the axis perpendicular to the longitudinal axis, an appropriate patient positioning for specific surgeries is intuitively possible. Furthermore, a Trendelenburg position and Anti-Trendelenburg position can be easily approached.

In further advantages implementation, the motion of the tabletop section supported by the column comprises a shifting along the longitudinal axis or a shifting in the direction perpendicular to the longitudinal axis.

Due to these features, also the shifting of the tabletop with respect to the column can be done in an intuitive manner in order to move the patient in a convenient position for the surgeon.

In a further advantages implementation, the motion of the tabletop section supported by the column comprises a height adjustment of the tabletop.

By this feature, also a height adjustment of the tabletop can be performed in an intuitive manner in order to move the patient in a convenient position for the surgeon.

In a further advantages implementation, the operation unit comprises a force sensitive sensor configured to actuate the drive of the movable tabletop section such that a speed of motion depends on a force exerted to the sensor.

When providing the surgical table having these features, a sophisticated control of the motions of the tabletop sectionals is possible by pressing the operating unit at an appropriate force.

In a further advantages implementation, the operating unit comprises a sensor touchpad as the force sensitive sensor.

By using the sensor touchpad in an operating unit, a reliable operating unit can be constructed in an easy manner since the sensor touchpad can be realized as being resistant for liquids and disinfectants and also for mechanical damages.

In a further advantages implementation, at least two operating units comprise color-coding having different colors.

Being provided with color-coding having different colors, the actuators can be assigned to specific functions, as e.g. Trendelenburg position (e.g. red color), Anti-Trendelenburg position (e.g. green color), tilting, or shifting, or to specific directions of motion.

In a further advantages implementation, the surgical table is provided with an activation unit which is configured to activate the operating units, and the surgical table is configured to deactivate the operating units after a certain time.

For avoiding dangerous situations, the operating units have to be activated by the activation unit such that the operating units cannot be unintentionally actuated but the operating units can only be intentionally activated. Furthermore, after a certain time, e.g. 10 seconds, the operating units are automatically deactivated again such that no subsequent unintentional actuation can happen.

According to a further aspect of the invention, a method for moving a movable tabletop section of a surgical table comprises the step: actuating a drive for the motion of the movable tabletop section with respect to the at least one of the adjacent tabletop section and the column by activating the operating unit fixed to the movable tabletop section.

By this step, the tabletop sections can be operated intuitively since the operating unit is fixed to the assigned tabletop section and there is no need to search and hold a remote control in the hand. Therefore, patient positioning will be transferred into an effortless process, even for small adjustments. Thus, for caregivers, it will be much more convenient to position the patient to the correct desired position without the need to hold a pendant. Furthermore, fine tuning of positioning can be done more intuitively since a motion of a hand actuating the operating unit is assisted by a drive of the tabletop section.

In an advantageous implementation, the operating unit is actuated by a specific exerted force to activate the drive at a speed according to the exerted force.

By exerting the specific exerted force, the drive for the motion of the movable tabletop section can intuitively be activated such that as higher the force is the faster the tabletop section moves. Due to this feature, the speed of an adjustment of the movable tabletop section can be easily steered in an intuitive manner.

BRIEF DESCRIPTION OF THE DRAWING

The invention is now elucidated by means of an embodiment referring to the attached drawing.

In particular, FIG. 1 shows a surgical table according to the invention.

In FIG. 1, a surgical table 1 according to the invention is shown. The surgical table 1 comprises the tabletop 2 having several tabletop sections 3, 3', 3".

DETAILED DESCRIPTION OF THE DRAWING

The surgical table 1 further comprises a column 4 for supporting the tabletop 2 by supporting one of the tabletop sections 3, 3', 3", 3'''.

The tabletop section 3 is a movable tabletop section which performs a motion with respect to the adjacent tabletop section 3' in a power-driven manner. The tabletop section 3" is also a movable tabletop section which also performs a motion with respect to the adjacent tabletop section 3' in a power-driven manner. The motion of the tabletop section 3, 3" comprises tilting with respect to the adjacent tabletop section 3'. The tabletop section 3''' is a movable tabletop section which performs a motion with respect to the adjacent tabletop section 3" by hand force.

The tabletop section 3' is a movable tabletop section which performs a motion with respect to the column 4 in a power-driven manner. Further, the tabletop 2 has a longitudinal axis 6 and the motion of the movable tabletop section 3' supported by the column 4 comprises tilting around an axis parallel to the longitudinal axis 6. Furthermore, the motion of the movable tabletop section 3' supported by the column 4 comprises tilting around an axis parallel to an axis perpendicular to the longitudinal axis 6. The position of the table top 2 after tilting around the axis perpendicular to the longitudinal axis 6 is known as Trendelenburg position or Anti-Trendelenburg position. Furthermore, the motion of the tabletop section 3 supported by the column 4 comprises the heat adjustment of the tabletop. In alternative embodiments, not all of these motions are provided.

For performing the motions, the tabletop sections 3, 3', 3" are provided with a respective drive 8. The respective drive 8 for the motion of the tabletop section 3, 3" with respect to the adjacent tabletop section 3' is arranged in the tabletop section 3, 3" to be moved by the respective drive 8. Alternatively, the drive 8 is arranged in the adjacent tabletop section 3'. The drives 8 for the motion of the tabletop section 3' with respect to the column 4 are arranged in both the tabletop section 3' and the column, however, in an alternative embodiment, they can be arranged either in the tabletop section 3' or in the column 4.

Alternatively, the tabletop sections 3, 3', 3" are not movable with respect to the adjacent tabletop section in a power-driven manner, and, merely, the tabletop section 3' supported by the column 4 performs a motion with respect to the column 4 in a power-driven manner. In further alternative embodiments, the tabletop section 3' does not perform a motion with respect to the column or the number of tabletop sections movable with respect to the respective adjacent tabletop section can vary.

The surgical table 1 is provided with operating units 5, 5' which are fixed to the movable tabletop sections 3, 3', 3" in order to actuate a motion of the respective tabletop section 3, 3', 3" with respect to the adjacent tabletop section 3' or to the column 4 in a power-driven manner.

The operating units 5, 5' respectively have a direction of actuation which corresponds to a direction of motion of the respective movable tabletop section 3, 3', 3". This means that when the operating unit 5, 5' is upwardly actuated, the assigned tabletop section moves upwardly or swivels such that the operating unit 5, 5' moves upwardly and vice versa.

The operating unit 5 comprises a force sensitive sensor 7 for actuating the drive 8 of the movable tabletop section 3, 3', 3" such that a speed of motion of the movable tabletop section 3, 3', 3" depends on the force exerted to the sensor 7. For reasons of clarity, merely one operating unit 5 is illustrated with the force sensitive sensor 7. However, all of the operating units 5, 5' are provided with the force sensitive sensor 7. The operating unit 5, 5' respectively comprises a sensor touchpad as the force sensitive sensor 7. Alternatively, instead of the sensor touch pad, the operating units 5, 5' can be provided with e.g. a strain gauge being operated by an actuator.

The operating units 5, 5' comprise color-coding having different colors. Usually, the operating unit 5, 5' initiating the Trendelenburg position comprises a red coding and the operating unit 5, 5' initiating the Anti-Trendelenburg position comprises a green coding. Furthermore, the remaining operating units 5, 5' are colored by an appropriate color. Alternatively, the operating units 5, 5' are not provided with any coding or they are coded e.g. by a specific shape or location.

The movable tabletop sections 3, 3', 3" respectively have a lying surface which is the upper surface of the tabletop section 3, 3', 3" on which a patient is lying. The operating units 5 are actuated from the lying surface side. The operating units 5' are actuated from the side opposite to the lying surface side. Alternatively, at least one of the operating units can be provided with several actuators which can be actuated from the lying surface side and from the side opposite to the lying surface side in order to control an assigned drive. Such an operating unit is e.g. arranged beside the tabletop 2 at the tabletop 2.

The movable tabletop sections 3, 3', 3" are respectively provided with a compressible upholstery 9, 9', 9", 9'" on the lying surface side. The operating units 5 are arranged below the lying surface provided by the upholsteries 9, 9', 9", 9'". Alternatively, the operating units 5 can be encompassed by the upholsteries 9, 9', 9", 9'".

Furthermore, the surgical table 1 is provided with an activation unit 10 which activates the operating units 5, 5'. The activation unit 10 is provided at the column 4 at an appropriate location for actuating the operating units 5, 5' by a caregiver. Alternatively, the activation unit 10 can be provided at another appropriate location, e.g. as a foot switch. In a further alternative embodiment, several activation units 10 are provided at different sides of the surgical table for providing the opportunity for the caregivers to operate the surgical table 1 at different locations.

In use, the drive 8 for the motion of the respective tabletop section 3, 3', 3" with respect to the adjacent tabletop section 3' or to the column 4 is actuated by actuating the operating unit 5, 5' fixed to the movable tabletop section 3, 3', 3".

If provided, the operating units 5, 5' are previously activated by means of the actuation unit 10 by the caregiver.

The operating unit 5, 5' is actuated by the specific exerted force to activate the drive at a speed according to the exerted force. Alternatively the exerted force is not recognized by the operating unit 5, 5' and merely an actuation for activating the drive at predetermined constant speed is recognized.

While the invention has been illustrated and described in detail in the drawing and the foregoing description, such illustration and description are to be considered illustrative or exemplary and not restrictive. The invention is not limited to the disclosed embodiments. From reading the present disclosure, other modifications will be apparent to a person skilled in the art. Such modifications may involve other features, which are already known in the art and may be used instead of or in addition to features already described herein.

The invention has been described in conjunction with various embodiments herein. However, other variations to the disclosed embodiments can be understood and effected by those skilled in the art in practicing the claimed invention, from a study of the drawings, the disclosure and the appended claims. In the claims, the word "comprising" does not exclude other elements or steps, and the indefinite article "a" or "an" does not exclude a plurality.

The invention claimed is:

1. A surgical table comprising: a tabletop having a plurality of tabletop sections, a column for supporting the tabletop by supporting one of the tabletop sections, and at least one user input device comprising a sensor touch pad as a force sensitive sensor, wherein one of the tabletop sections is a movable, power-driven, tabletop section that is movable at least with respect to another of the plurality of table top sections, and the user input device is located on the movable tabletop section, and wherein the sensor touch pad is configured to adjust a speed of movement of the power-driven tabletop section proportional to a non-zero force exerted on the sensor touch pad directly by a user.

2. The surgical table of claim 1, wherein the direction of motion of the movable tabletop section is responsive to the direction of force exerted on the force sensitive sensor.

3. The surgical table of claim 1, wherein movement of the movable tabletop section comprises tilting with respect to an adjacent table top section.

4. The surgical table of claim 1, wherein the tabletop has a longitudinal axis, and movement of the movable tabletop section supported by the column comprises tilting around an axis parallel to the longitudinal axis of the tabletop.

5. The surgical table of claim 1, wherein the tabletop has a longitudinal axis, and movement of the movable tabletop section supported by the column comprises tilting around an axis parallel to an axis perpendicular to the longitudinal axis of the tabletop.

6. The surgical table of claim 1, wherein the tabletop has a longitudinal axis, and movement of the movable tabletop section supported by the column comprises shifting along the longitudinal axis or shifting in a direction perpendicular to the longitudinal axis of the tabletop.

7. The surgical table of claim 1, wherein movement of the tabletop section supported by the column comprises a height adjustment of the tabletop.

8. The surgical table of claim 1, wherein at least two user input devices comprise color-coding having different colors.

9. A surgical table comprising: a tabletop having a plurality of tabletop sections, a column for supporting the tabletop by supporting one of the tabletop sections, and at least one user input device comprising a touch pad as a force sensitive sensor, wherein one of the tabletop sections is a movable, power-driven, tabletop section, the user input device is located on the movable tabletop section, and the movable, power-driven, tabletop section is configured to move at a speed that is proportional to a non-zero force exerted on the touch pad sensor directly by a user.

10. The surgical table of claim 9, wherein the direction of motion of the movable tabletop section is responsive to the direction of force exerted on the force sensitive sensor.

11. The surgical table of claim 9, wherein at least two user input devices comprise color-coding having different colors.

* * * * *